US006077551A

United States Patent [19]

Scrimager

[11] Patent Number: 6,077,551

[45] Date of Patent: Jun. 20, 2000

[54] MICROWAVE POPCORN PREPARATION AND SERVING PACKAGE WITH RELEASABLY ADHERED LAP SEAM

[75] Inventor: Cynthia Scrimager, Anaheim, Calif.

[73] Assignee: Hunt-Wesson, Inc., Fullerton, Calif.

[21] Appl. No.: 09/090,200

[22] Filed: Jun. 4, 1998

[51] Int. Cl.[7] ..... B65D 30/10

[52] U.S. Cl. ..... 426/107; 426/111; 426/115; 426/123; 383/200; 383/209; 383/211

[58] Field of Search ..... 426/107, 111, 426/113, 115, 122, 123, 234, 243; 383/207, 211, 209, 208, 200; 229/87.05, 307, 313

[56] References Cited

U.S. PATENT DOCUMENTS

| | | | |
|---|---|---|---|
| 2,306,335 | 12/1942 | Feigenbutz | 383/207 |
| 2,684,807 | 7/1954 | Gerrish | 383/66 X |
| 3,070,225 | 12/1962 | Schwartz | 206/438 |
| 3,114,643 | 12/1963 | Boston et al. | 426/113 |
| 3,259,303 | 7/1966 | Repko | 383/211 |
| 3,613,874 | 10/1971 | Miller | 206/46 F |
| 3,873,735 | 3/1975 | Chalin et al. | 426/87 |
| 4,292,322 | 9/1981 | McHam | 426/111 |
| 4,292,332 | 9/1981 | McHam | 426/111 |
| 4,571,337 | 2/1986 | Cage et al. | 426/107 |
| 4,596,713 | 6/1986 | Burdette | 426/107 |
| 4,638,911 | 1/1987 | Prohaska . | |
| 4,691,374 | 9/1987 | Watkins et al. | 383/104 |
| 4,904,488 | 2/1990 | LeBaw et al. | 426/107 |
| 4,925,684 | 5/1990 | Simon | 426/107 |
| 5,100,003 | 3/1992 | Jud | 229/87.05 |
| 5,203,634 | 4/1993 | Kim | 383/205 |
| 5,335,996 | 8/1994 | Cortopassi et al. | 383/207 |
| 5,460,839 | 10/1995 | Archibald | 426/107 |
| 5,461,216 | 10/1995 | McDonald et al. | 426/107 X |
| 5,473,142 | 12/1995 | Mass | 426/107 X |
| 5,507,579 | 4/1996 | Sorenson | 383/207 |
| 5,770,839 | 6/1998 | Ruebush et al. | 426/234 X |

FOREIGN PATENT DOCUMENTS

| | | | |
|---|---|---|---|
| 0453198 | 6/1998 | Switzerland | 383/207 |
| 87/02011 | 4/1987 | WIPO | 383/211 |
| 92/22475 | 12/1992 | WIPO | 426/111 |

*Primary Examiner*—Milton Cano
*Assistant Examiner*—Sherry A. Daverman
*Attorney, Agent, or Firm*—Pretty, Schroeder & Poplawski

[57] ABSTRACT

An expandable microwave popcorn package which contains a charge of popcorn kernels suitable for preparation in a microwave oven. The package is formed of front and back panels preferably joined together at the top and bottom ends and at the sides by side panels. The back panel includes two or more sections which are joined along slightly overlapping edges and bonded together by a releasable adhesive, thereby forming lap seam(s). Conversion of the package into a serving vessel is made possible by the releasable nature of the adhesive which allows the lap seam(s) to be disengaged after the popping process is complete. Thus the back panel sections can be detached, and possibly removed, to expose the popcorn within the package. Ideally the heat and steam created by the popping process will diminish the bonding strength of the releasable adhesive thereby enhancing the conversion. Separation lines, along which the structural integrity of the package is relatively weak, may also be used in conjunction with a lap seam to enhance the conversion while avoiding manufacturing problems associated with multiple lap seams.

4 Claims, 10 Drawing Sheets

FIG. 3
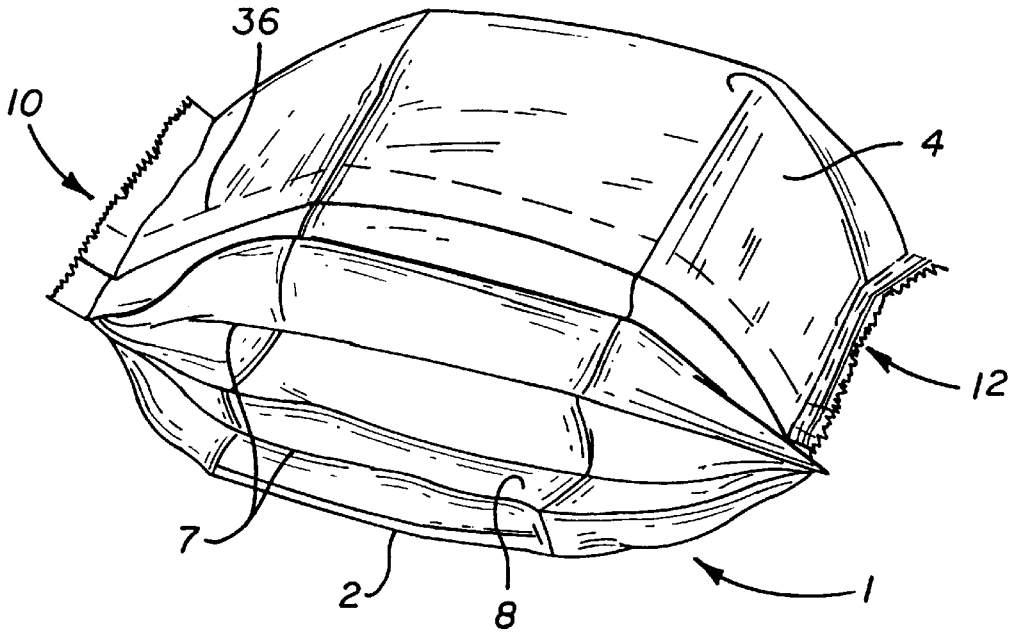
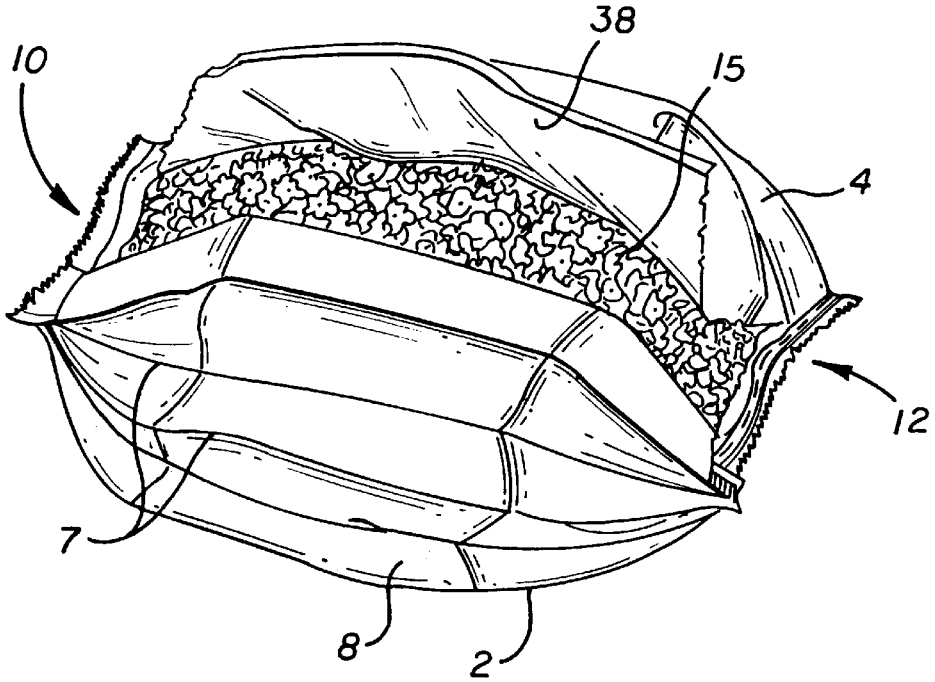
FIG. 4

FIG. 5
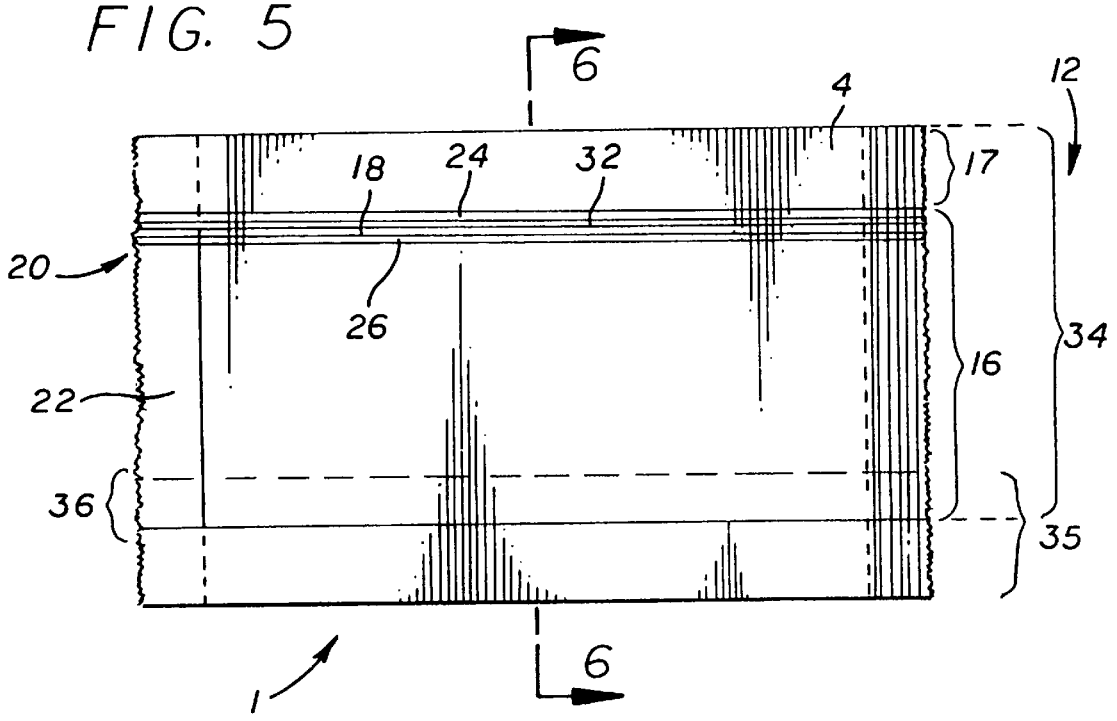
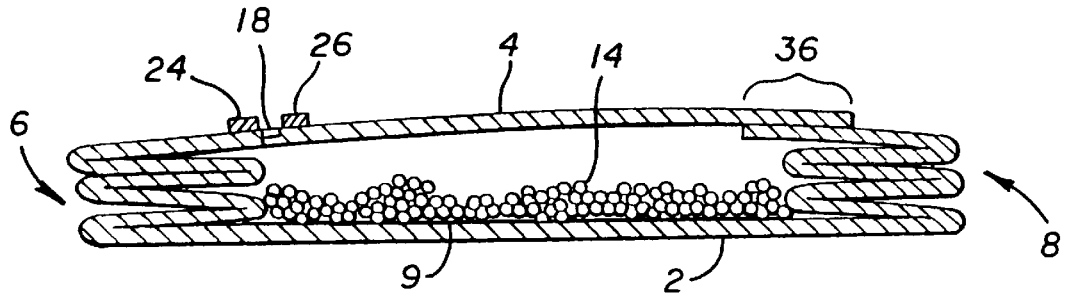
FIG. 6

FIG. 7
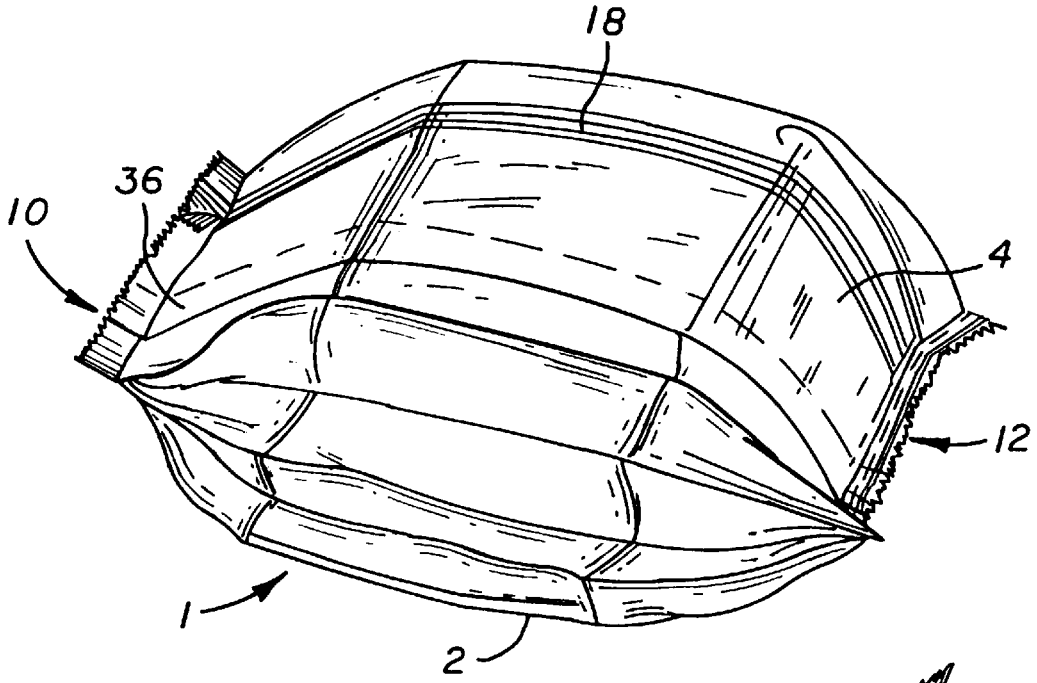
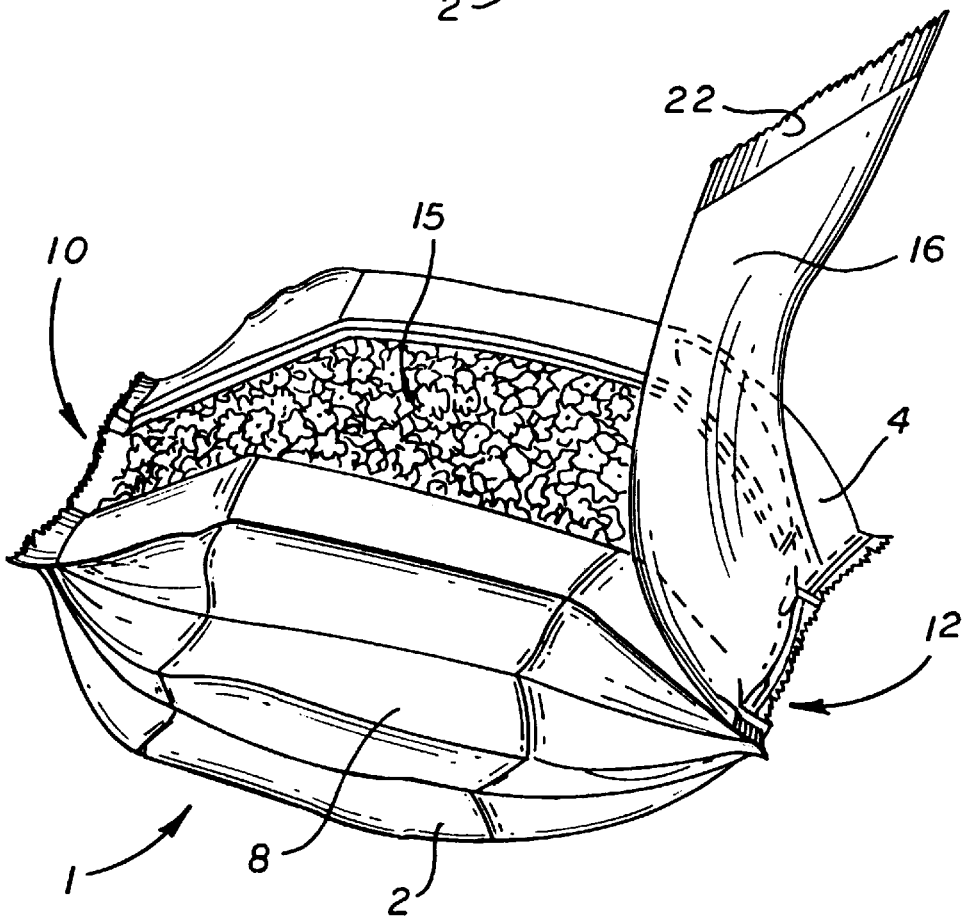
FIG. 8

FIG. 9
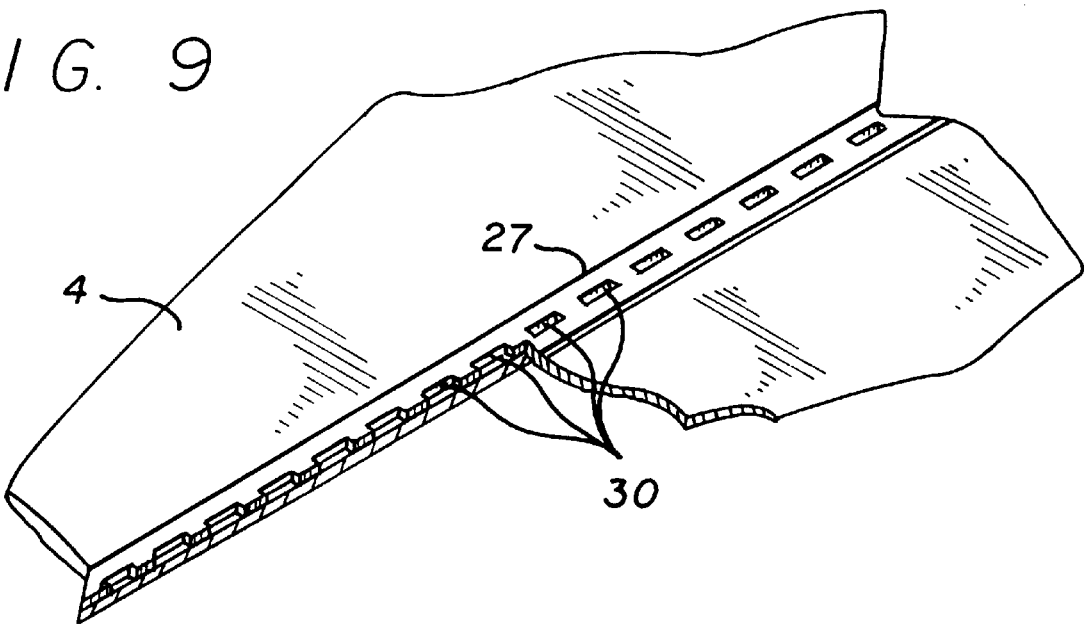
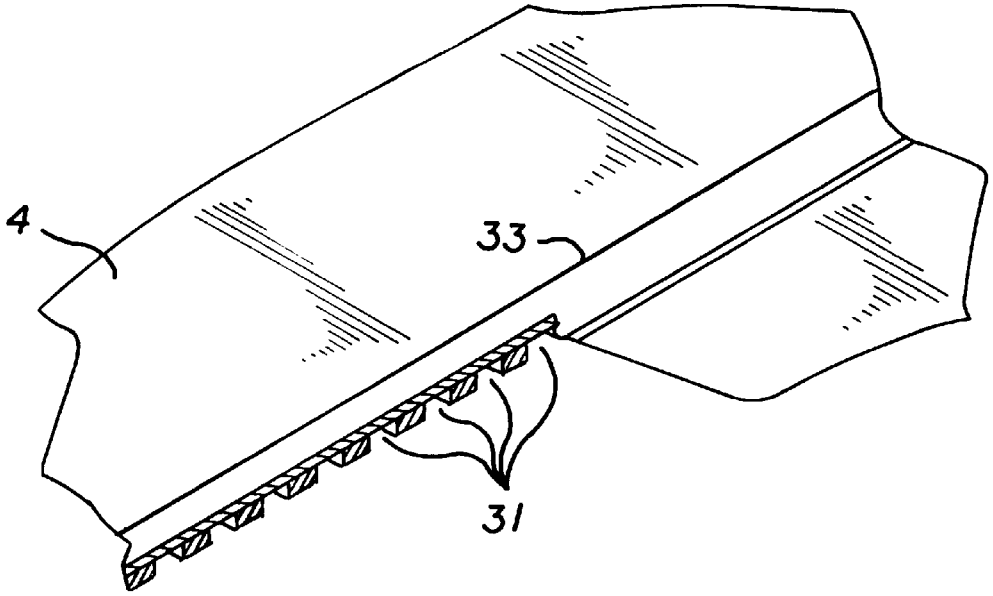
FIG. 10

FIG. 11
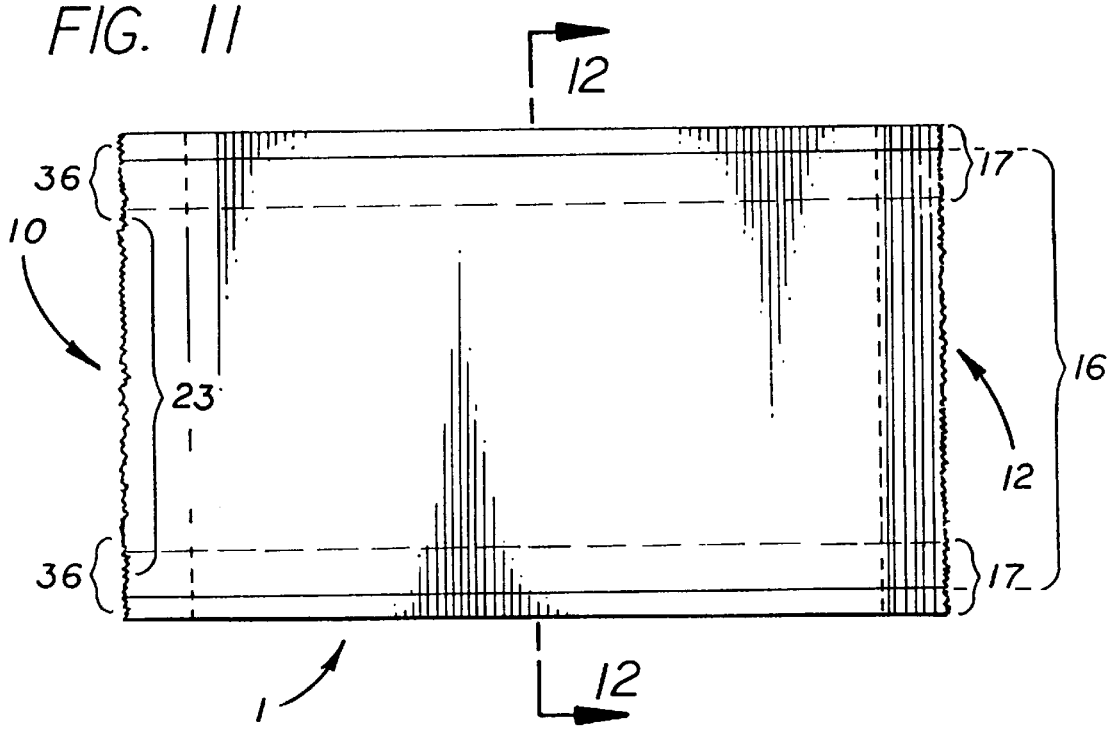
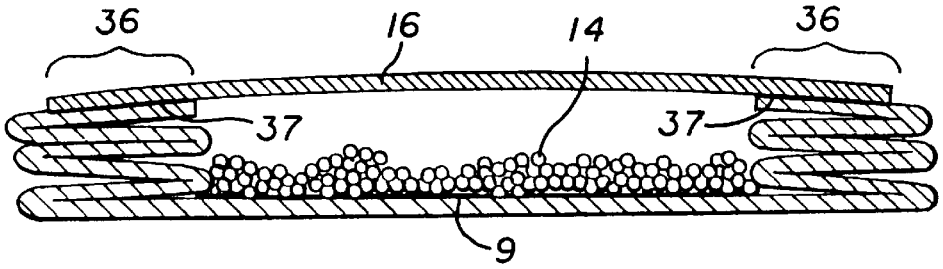
FIG. 12

FIG. 13
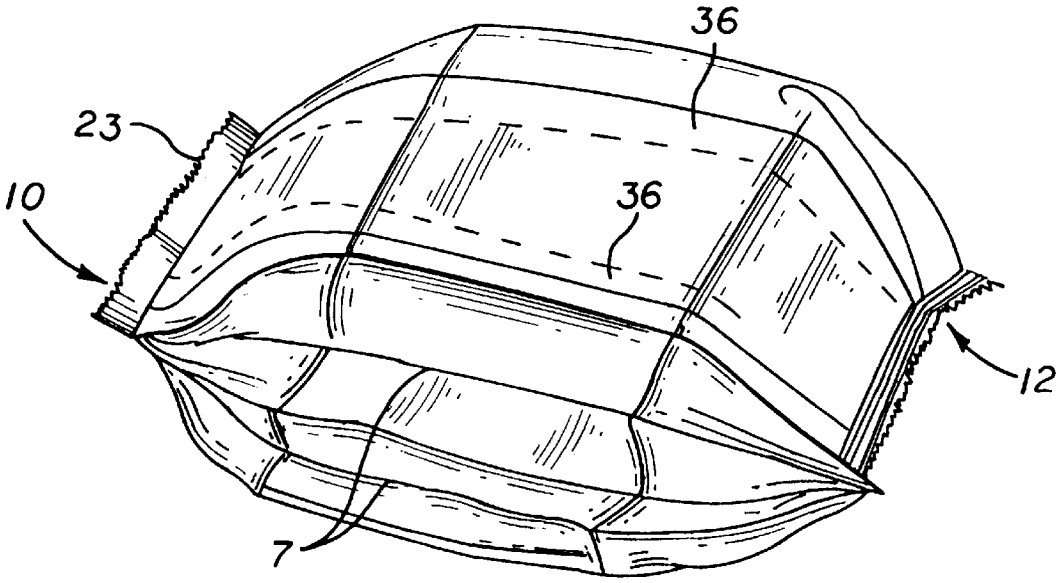
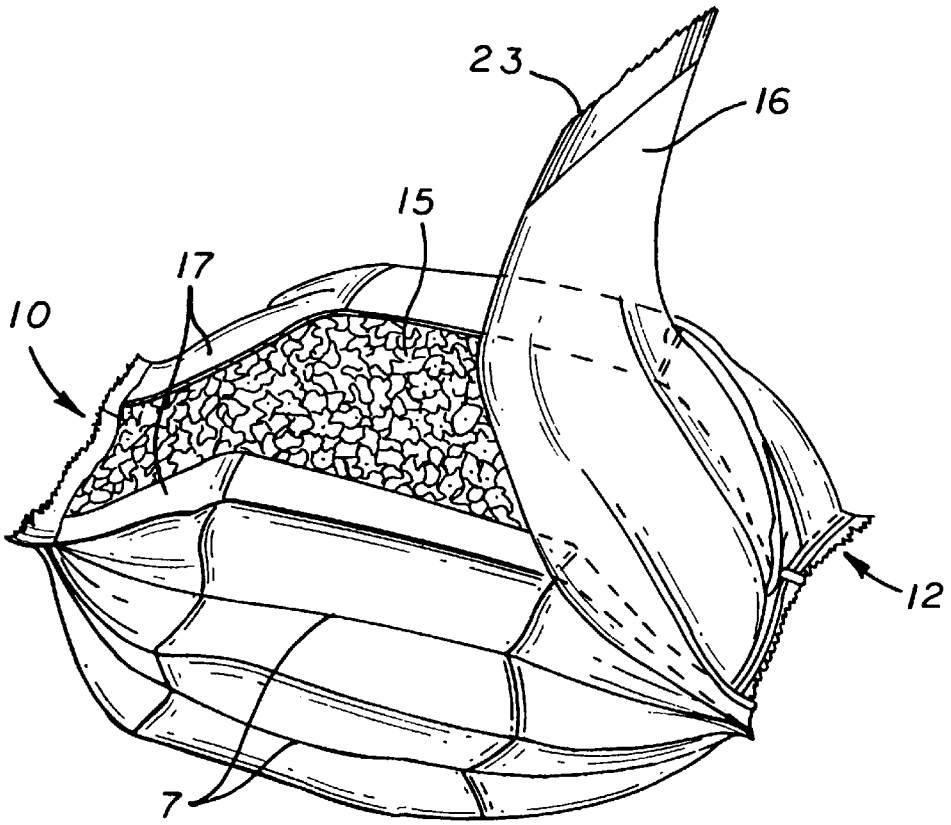
FIG. 14

FIG. 15
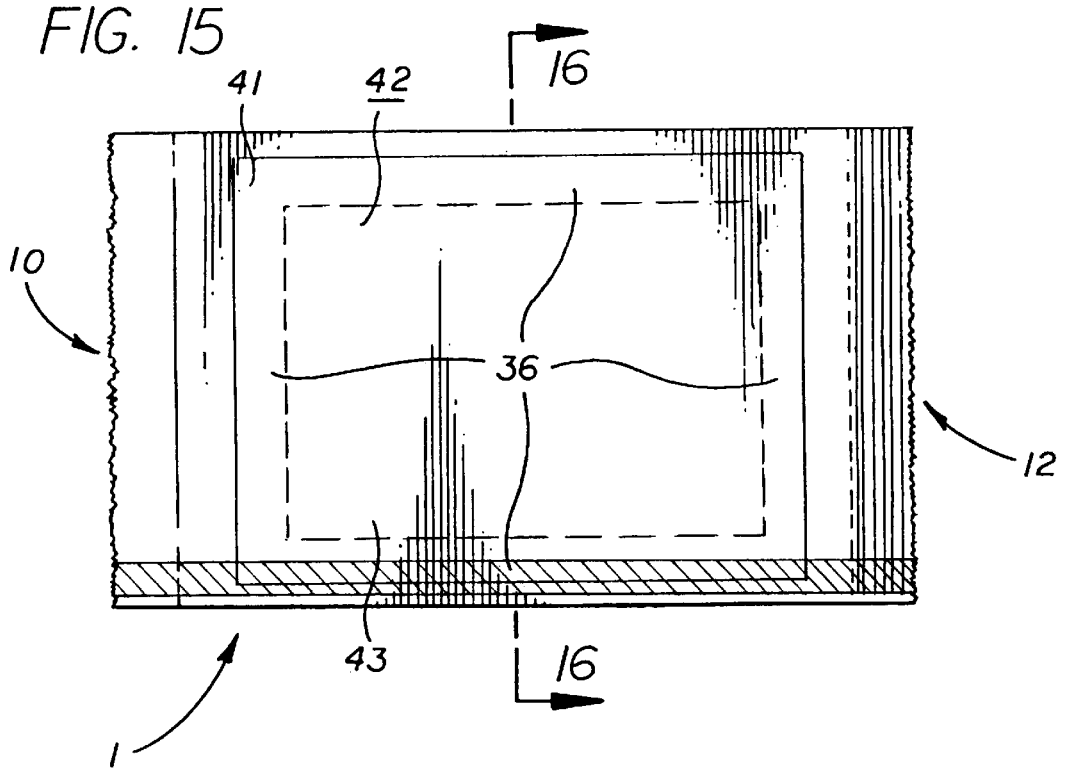
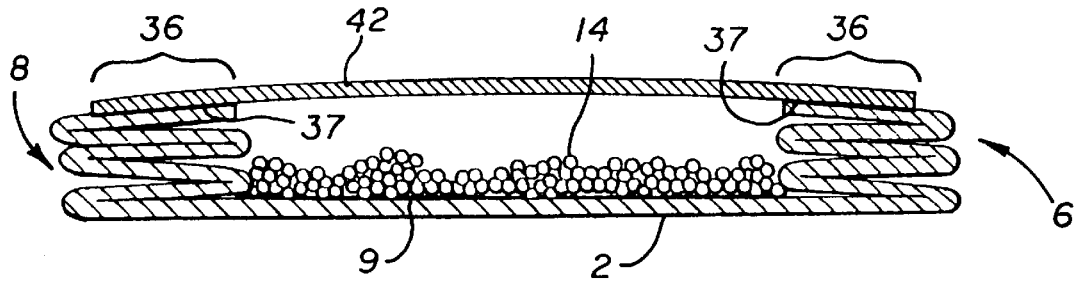
FIG. 16

FIG. 17
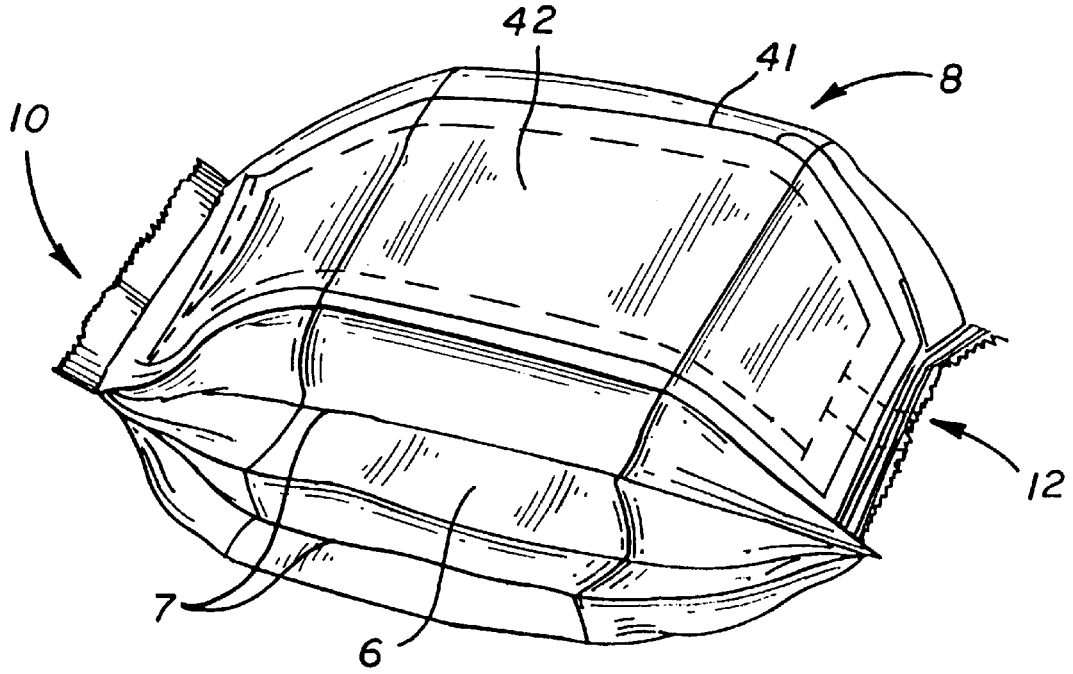
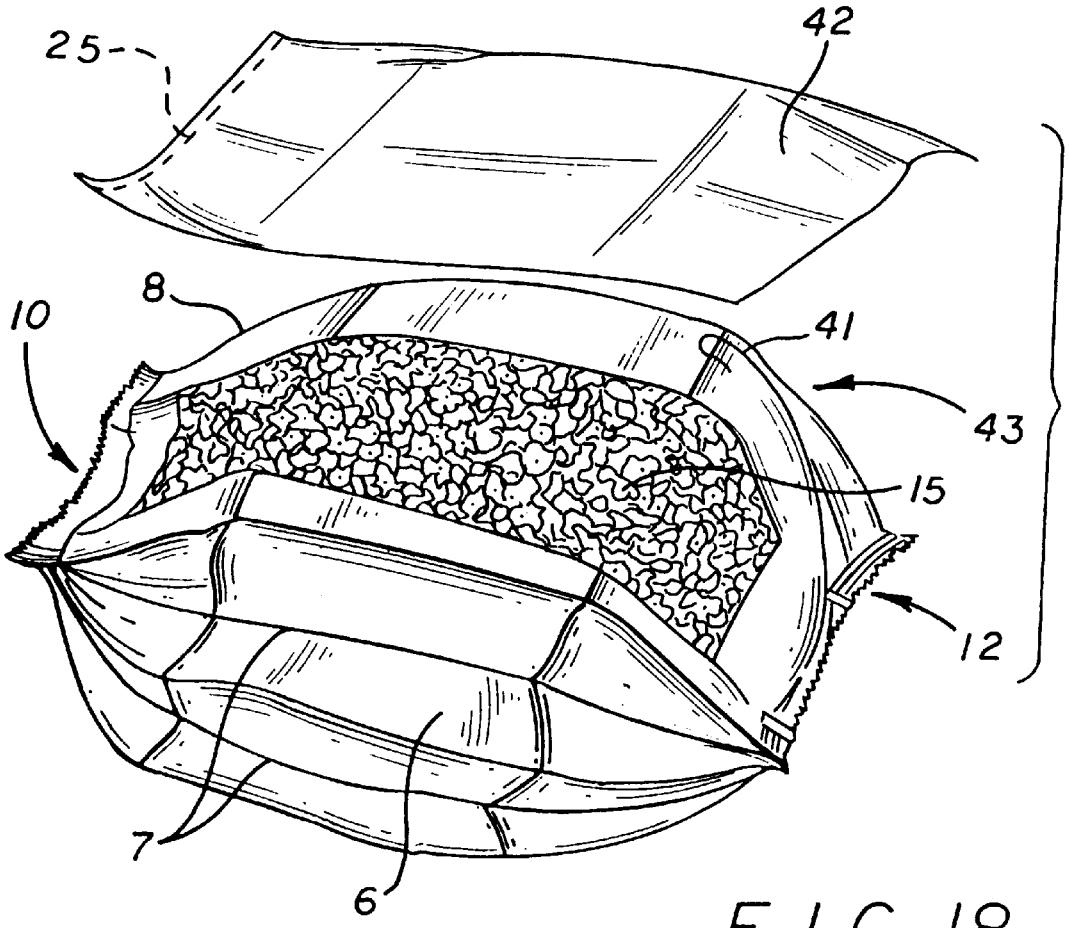
FIG. 18

MICROWAVE POPCORN PREPARATION AND SERVING PACKAGE WITH RELEASABLY ADHERED LAP SEAM

FIELD OF THE INVENTION

The present invention relates to an expandable package for containing a charge of popcorn kernels before, during and after it has been prepared in a microwave oven. More particularly, this invention relates to a multi-purpose package that can be converted into a convenient serving container by separating adjacent panel sections along one or more releasably adhered lap seams, thereby providing access to the prepared popcorn within the package.

BACKGROUND OF THE INVENTION

Microwavable popcorn has become a very popular snack item, convenience being a major contributor to its popularity. Microwave popcorn can be stored in a ready-to-use, shelf-stable, leak-proof package, which also serves as the cooking container. Packages of this type are designed to store a charge of edible ingredients, including popcorn kernels, shortening and optional seasonings or flavorings, in a collapsed configuration that reduces storage requirements and shipping costs. When the popcorn package is subjected to microwave energy, the popcorn kernels within the package rupture and assume the familiar shape of popped popcorn and the package expands to accommodate the increased volume.

One package style that has been used to prepare popcorn in a conventional microwave oven is described in U.S. Pat. No. 4,571,337 to Cage. It is a traditional flat-bottom, gussetted bag with the top end crimp-sealed. Prior to cooking, the charge of kernels and other edible ingredients has a relatively small volume, allowing the gussets to remain inwardly folded so that the package can assume a relatively flat shape for shipping and storage. Steam generated during cooking is held in the bag for a portion of the process until the bag is expanded, after which steam is vented through the top seal. When the popcorn is ready to be served, the top end of the bag can be opened by pulling on diagonally opposite corners of the package.

Another common style is the wedge-bottom, or pinch-bottom bag, as illustrated in U.S. Pat. No. 4,596,713 to Burdette. In this package, the top and bottom ends are both sealed by crimping or high temperature adhesive (there is no bottom panel), and the edges of the front and back panels are joined by side panels with gussets extending into the package. The charge of popcorn is placed in the center portion of the package, and the top and bottom ends are flattened and folded over the more bulky center portion to maintain this placement. As the kernels are popped, their increasing volume fills the entire package. This package is likewise opened at the top end after cooking to provide access to the contents within.

Most microwavable popcorn containers sold today include a susceptor in the panel of the package that rests underneath the charge of popcorn in the cooking position. The susceptor quickly converts microwave energy to thermal energy, thereby hastening the popping process and introducing steam to the interior of the package. The use of a susceptor generally results in larger pop volume and fewer unpopped kernels. Susceptors are sometimes combined with multiple gussets in each side panel for still greater pop volume.

When a still folded package is to be cooked, it is placed inside the microwave oven with the section containing the susceptor on the oven floor, and the charge of popcorn resting on the susceptor to the maximum extent. During cooking, the internal pressure of steam released by the kernels and the increased volume of the popped kernels causes the two end sections to gradually unfold longitudinally. As the process continues, the gussets also unfold allowing the package to approach its full volume. This process continues until substantially all of the kernels have popped, or until the early pops are in danger of scorching, at which time the package is removed from the microwave oven. The optimum cooking time depends on the characteristics of the particular oven and the popcorn kernels used, e.g., their moisture content.

Traditional packages leave something to be desired as to the convenience with which the edible popcorn is accessed. After the popcorn has been prepared, one end of the package must be opened, often by pulling opposing corners, as described in U.S. Pat. No. 4,571,337. Then the consumer can either pour the contents into a separate serving bowl, or, if separate container is not readily available, eating directly from the package is a viable but messy option. The consumer may not be able to reach the popcorn at the bottom of the package without coming into contact with shortening, grease or other ingredients that tend to coat the inside surfaces of the package. Moreover, if the consumer wishes to add toppings, such as butter or caramel, to the corn after popping, it will be very difficult to apply a well distributed coating through the open end of the package.

In view of the foregoing, it should be appreciated that there is a need for an microwave popcorn package that can be used not only for the storage and preparation of popcorn, but which also can be converted into a convenient serving vessel with an improved opening configuration.

SUMMARY OF THE INVENTION

This invention pertains to a multi-purpose microwave popcorn package that can store a charge of unpopped popcorn kernels, that is capable of expanding to accommodate the increased volume of popcorn as it is popped in response to microwave energy, and that will ultimately convert into a convenient serving vessel for the resulting edible popcorn. This package provides increased convenience for the user at no significant additional cost. Moreover, these objectives are accomplished with a design that is simple and inexpensive to manufacture.

The primary structural components of the package include a front panel, a back panel and two side panels which join the sides of the front and back panels. In the preferred wedge-bottom package, the top and bottom ends of the front and back panels are joined directly together to close the package. In an alternative flat-bottom design, an additional bottom panel is provided to complete the juncture between the bottom ends of the front and back panels.

An important feature of this invention is that one of the panels, typically the back panel, is divided into at least two adjacent sections, one of which slightly overlaps the other along a lap seam. The lap seam extends from the top end of the package toward the bottom end, and is bonded with a releasable adhesive. Thus, after the popcorn has been popped and the package has expanded to accommodate the increased volume, the package can be easily converted into a serving vessel by separating the sections along the lap seam. This lengthwise opening provides more convenient access than traditional packages which open at one end.

Another aspect of the invention relates to a pull tab at one the edge of the lap seam to assist in separating the back panel sections. This is accomplished by leaving the outermost edge of the overlapping section free of adhesive and thereby free from the underlying section. Thus when it is time to open the package the consumer will have an adhesive free handhold by which to initiate detachment of the lap seam.

Another aspect of the present invention utilizes an adhesive which has a relatively high bonding strength before the cooking process, but which diminishes in strength when subjected to heat and steam generated by the cooking process. This feature ensures the integrity of the package during storage and transportation, while making it easier to detach the lap seam when the cooking process is complete.

Another aspect of this invention utilizes a lengthwise strip of relatively low structural strength, otherwise known as a tear line, placed parallel to the lap seam. Following the rule that a tear will tend to continue along the path of least resistance, the tear line provides another path along which the back panel can be separated in addition to that provided by the lap seam. Thus the entire middle section between the tear line and the lap seam can be detached from the package creating a relatively wide hole to access the popcorn.

Tear lines are created by weakening the package material along the tear line and/or reinforcing the material immediately adjacent the tear line. To reduce the strength of the back panel, perforations or score lines can be formed along the tear line. Where perforations are used to form the tear line, a cover strip can be adhered to the back panel over the perforations. This prevents leakage of oils or seasonings through the perforations, and helps prevent the tear line from splitting prematurely.

In another embodiment of this invention, the material immediately adjacent the tear line is reinforced with a strip of pressure-sensitive tape. An outer reinforcement strip placed between the tear line and the nearest side panel will prevent the tear from turning toward the outer portions of the package. Thus the outer sections of the back panel and side panels will remain intact to support the package after the middle section has been removed. An inner reinforcement strip can also be placed between the tear line and the lap seam to prevent the tear from reducing the size of the removable section. Such reinforcement strips provide a simple and economical means to define the tear lines without compromising the integrity of the package itself.

According to another embodiment of the invention, a single strip of pressure-sensitive tape can be used to reinforce both the inner and outer sides of the tear line. This wider piece of reinforcement tape is placed directly above the desired tear line and the reduced structural integrity of the tear line is accomplished by forming perforation along the longitudinal center line of the tape. Thus a tear initiated along the center of the tape will tend to follow the line of perforations.

Another aspect of the present invention utilizes multiple gussets folded into each side panel to increase both popping efficiency and accessability to the package's interior. These multiple gussets provide the same expansion possibilities of larger single gussets but with smaller intrusions into the package. Thus they tend to interfere less with the popping process, and after the lap seam has been detached, it is easier for the consumer to reach into the package without contacting the side walls.

According to another aspect of this invention, the tear line is located directly adjacent the inner edges of the gussets. When the package is fed through rollers to crease the folded gussets and seal the ends, and when the package is handled later, the variation in thicknesses near the folds tend to create score lines along the adjacent sections of the front and back panels. If a tear line extends along these score lines there will be less need, or perhaps no need, for reinforcement or additional weakening of the package material. An alternative embodiment takes advantage of the same score lines by placing the longitudinal tear line inward of the inner gusset folds. Thus if the tear deviates outwardly from the intended path, it will tend to turn back toward the bottom of the package when it reaches the gussett edge.

Another embodiment utilizes a second lap seam in place of the lengthwise tear line discussed above. In this embodiment the back panel is divided into a middle section located between two outer sections. The outer edges of the middle section slightly overlap each of the outer sections, and the resulting lap seams are bonded with releasable adhesive. Thus when the top end of the middle section is torn or pulled away, the middle section can be peeled down the package until it is connected only at the bottom end. The middle section can then be pulled off the package entirely, or simply folded over. A pull tab may be provided on this arrangement as well.

Another embodiment of the invention utilizes a back panel which frames an opening to the interior of the package and a cover which closes the opening. The outer edges of the cover slightly overlap the inner edges of the frame along a circumferential lap seam, and the lap seam is bonded with releasable adhesive. Preferably at least one edge of the cover is left free of adhesive to provide a pull tab as described above. This cover can be removed entirely without requiring any tearing of the package.

Other features and advantages of the present invention will become apparent from the following description of the preferred embodiments, taken in conjunction with the accompanying drawings which illustrate, by way of example, the principles of the invention.

BRIEF DESCRIPTION OF THE DRAWINGS

FIG. 3 is a pictorial illustration showing the package of FIG. 1 in perspective, after it has been expanded.

FIG. 4 is a pictorial illustration, similar to FIG. 3, after the lap seam has been detached and the overlapping section has been folded over.

FIG. 5 is plane view of another embodiment of the invention with a single lap seam and a parallel tear line.

FIG. 6 is a cross-sectional side view of the package taken along the line 6—6 of FIG. 5.

FIG. 7 is a pictorial illustration showing the package of FIG. 5 in perspective, after it has been expanded.

FIG. 8 is a pictorial illustration, similar to FIG. 7, after a portion of the section between the lap seam and tear line has been detached.

FIG. 9 is an elevational/sectional view along the tear line of another embodiment of the invention similar to that illustrated in FIGS. 5–8 except that the tear line is formed by a relatively wide reinforcement strip with a perforated centerline.

FIG. 10 is an elevational/sectional view along the tear line of another embodiment of the invention similar to that illustrated in FIGS. 5–8 except that the tear line is formed by a series of perforations in the back panel, covered by a sealing strip.

FIG. 11 is plane view of another embodiment of the invention in which a removable middle section is located between two parallel lap seams.

FIG. 12 is a cross-sectional side view of the package taken along the line 12—12 of FIG. 11.

FIG. 13 is a pictorial illustration showing the package of FIG. 11 in perspective, after it has been expanded.

FIG. 14 is a pictorial illustration, similar to FIG. 13, after the middle section has been detached.

FIG. 15 is plane view of another embodiment of the invention with a framed opening into the interior of the package and a cover slightly overlapping the inner edges of the frame.

FIG. 16 is a cross-sectional side view of the package taken along the line 16—16 of FIG. 15.

FIG. 17 is a pictorial illustration showing the package of FIG. 15 in perspective, after it has been expanded.

FIG. 18 is a pictorial illustration, similar to FIG. 17, after the cover has been detached.

DESCRIPTION OF THE PREFERRED EMBODIMENTS

Figure 1:
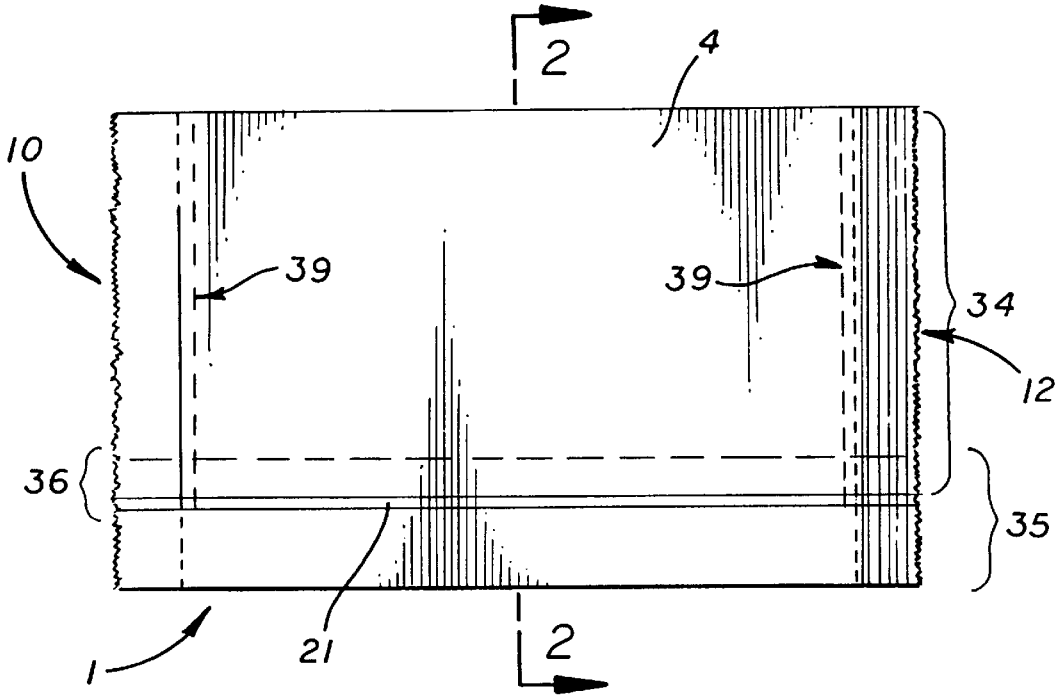
FIG. 1 is a plane view of an embodiment of the invention with a single lap seam extending longitudinally down the back panel.

The present invention relates to a microwave popcorn product, generally indicated as 1 in the accompanying drawings. The package 1 contains a charge of popcorn kernels 14 that expand into puffed edible popcorn 15 during preparation in a microwave oven. The package 1 can also serve as a vessel from which the popcorn 15 can be conveniently removed and eaten, and which allows users to conveniently add toppings to the prepared popcorn without first removing it from the package.

As shown in FIGS. 1–4, the primary structural components of the package 1 include a rectangular front panel 2, a rectangular back panel 4, and two rectangular side panels 6 and 8 which connect the sides of the front and back panels. Various sheet materials may be used to form the panels, so long as the basic requirements of the package 1 are met. The package must be stiff enough to generally maintain its expanded shape without tearing while the popcorn is being prepared, but at the same time it must be flexible enough that the internal steam and popcorn volume can expand the package from its compressed configuration. Additionally, the material should be resistant to leakage or staining before, during or after popcorn preparation. A two-ply construction with an inner grease-proof paper layer of 20–25 lbs, and an outer machine finished paper layer of 20–25 lbs is suitable. A suitable material for a single ply package is a paper approximately 0.5 to 1.0 mils thick with a weight of about 35–60 lbs. Machine glazed papers are also suitable, but can be too rigid if they are too thick. The surface of the paper is treated with a commercially available fluorocarbon stain inhibitor.

All four panels define a top end generally indicated by 10 and a bottom end generally indicated by 12. Both ends of front panel 2 and back panel 4 must be connected to close package 1 and fully contain popcorn 14 and other ingredients. The preferred way to close the ends is to use the "tube" method in which the top and bottom ends are secured directly to each other. A heat sensitive adhesive (not shown) is applied to the inner surfaces near both ends of the panels. When it is desired to close the ends, they are simply placed in a heated press which presses them together at an elevated temperature. Typical adhesives used to close the ends include polyvinyl acetate or polyethylene vinyl acetate, suited for high temperature applications.

Figure 19:
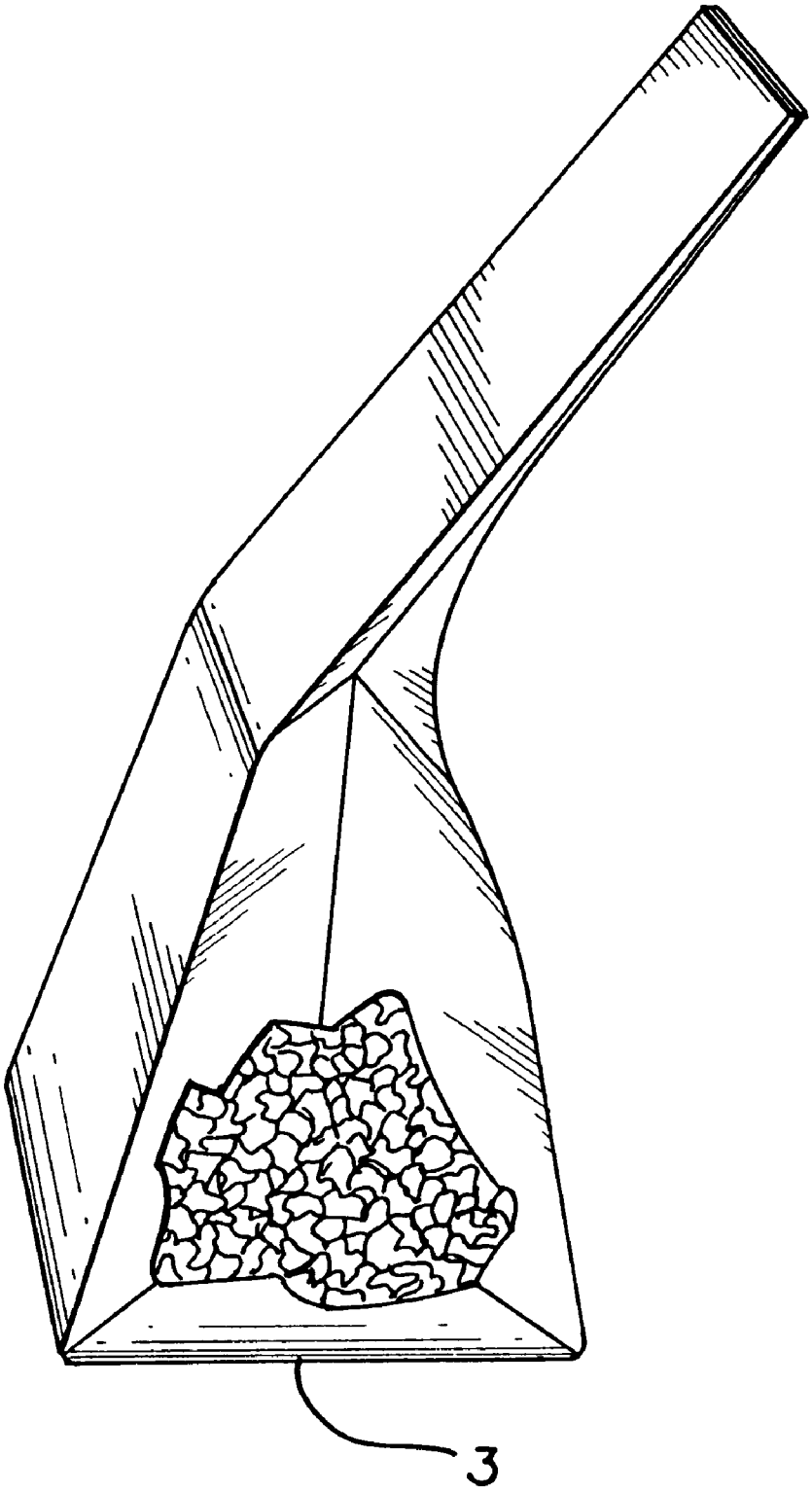
FIG. 19 is a pictorial illustration of an embodiment of the package illustrating a bottom panel that joins the bottom ends of the front and back panels.

An alternative bag construction joins the bottom ends 12 of the front panel 2 and back panel 4 with an additional bottom panel 3 as illustrated in FIG. 19. An example of this type of package is described in more detail in U.S. Pat. No. 4,571,337, which is incorporated herein by reference, and can be used in combination with the easy opening features of this invention. The flat-bottom arrangement allows the package to stand upright. However, since packages constructed according to the tube method are more efficient to manufacture with a susceptor and more appropriate for conversion into a horizontal serving vessel, the following descriptions will focus on tube style packages.

Figure 2:
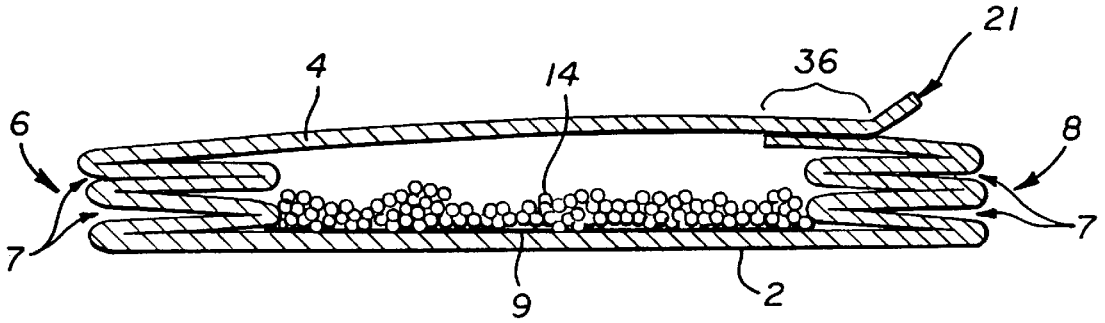
FIG. 2 is a cross-sectional side view of the package taken along the line 2—2 of FIG. 1.

As best shown in FIG. 2, the side panels 6, 8 of the package 1 each include two gussets 7 which allow the package 1 to maintain a collapsed configuration prior to the preparation of the popcorn 14. These multiple gussets 7 are formed in each side panel by creating parallel inward folds along the longitudinal axis of the package 1 that give the side panel a pleated or accordion-like configuration. The stiffness of the side panel material causes the gussets 7 to remain compressed so that the package 1 stays relatively flat during storage and shipment. However, the side panel material is flexible enough to allow the gussets 7 to expand to accommodate increased interior volume as the popcorn 15 is cooked (as illustrated in FIGS. 3–4). The use of two or more gussets 7 on each side is preferred, for reasons explained below.

The contents of the package 1 principally include a charge of unpopped kernels 14 which will expand into the popped kernels 15 that fill the expanded volume of the package. Also preferably included in the charge 14 is a quantity of shortening and seasonings to enhance the flavor and texture of the resulting popcorn 15. Room temperature stable shortening is selected so that refrigeration is not required, and the charge 14 is solid at room temperature.

Referring again to the cross-sectional view of FIG. 2, a preferred embodiment also includes a susceptor 9 adhered to the front panel 2 to enhance popping performance. A susceptor is a very thin sheet of material, usually formed of a metal such as aluminum, that rapidly increases in temperature and radiates heat energy when subjected to microwave energy, thereby raising the temperature within the package. Susceptors are important to popping efficiency as an ideal package would pop all of the kernels in the shortest time possible. The mechanics of popping corn depend on several factors, such as the size of the kernels, the thickness of the outer shells of the kernels, and the moisture content within the inner portion of the kernel. Ideally, all of the kernels within a particular package fall within a very narrow range of these variables so that they will all pop at about the same time, thus preventing the earlier popped kernels from scorching as cooking continues. Susceptors tend to keep the lag time between the early and late pops as short as possible. They also increase pop volume and decrease the number of "unpops."

The embodiment illustrated in FIGS. 1–4 exemplifies one of the more cost effective applications of this invention. The back panel of this embodiment is formed by two sections both of which extend the length of the package. The first section 34 is the wider of the two and slightly overlaps the second section 35 along a lap seam 36. The lap seam 36 is approximately ½" to 1" wide and preferably lies above the gussets of one of the side panels 6 or 8. The lap seam is bonded by a releasable adhesive 37 (generally illustrated by the shaded portion along the lap seam in FIG. 2) which permits it to be separated after the popcorn has been popped. Thus a lengthwise opening can be created in the back panel by detaching the overlapping edges of the lap seam and separating the sections of the back panel.

In the embodiment of FIGS. 1–4, if only the lap seam 36 is detached, the opening will be relatively small, especially near the top end 10 and bottom end 12. This is because the first section 34 will still be connected to the remainder of the package 1 at the ends 10 and 12. If the consumer desires a larger opening, crosswise tears can be made in the areas near the ends, as generally indicated as 39 on FIG. 1. This will create a flap 38, best illustrated in FIG. 4, which can then be folded to one side and out of the consumer's way. Alternatively, if the adhesive selected to secure the top and bottom ends of the first section is weak enough, or is applied in a thin enough strip, the ends of the first section can simply be peeled from the remainder of the package to create a flap similar to, but slightly longer than, flap 38. If this alternate construction is used, however, the end adhesive must remain strong enough to prevent the package from rupturing prematurely before or during the cooking process. A readily available adhesive that can be used for this purpose consists of polyvinyl acetate or polyethylene vinyl acetate with a strip width of 0.25 inch to 1.00 inch. Of course, the second section could also be torn or peeled back in a manner similar, but this is typically not necessary if the first section is made large enough by positioning the lap seam near one side of the package.

A pull tab 21 can also be provided along the outermost edge of the lap seam. This is best accomplished by leaving the outermost edge of the first section 34 free of adhesive and thereby free of the underlying second section 35. Thus when it is time to open the package, the consumer will have a handhold with which to grasp the edge of the first section and initiate detachment of the lap seam.

The adhesive used to bond the lap seam must serve two competing functions. It must be strong enough that the lap seam will not split prematurely during shipping or storage, or while the package is expanding during the popping process. However, it must also be weak enough that when the popping process is complete, the lap seam can be easily detached without tearing the adjacent panel material. The minimum bonding strength required of the adhesive is generally determined by stresses expected to be imparted on the package before cooking. Of course this will vary depending on multiple factors, e.g. the manufacturing processes, shipping methods and care taken by the consumer.

With respect to the maximum bonding strength for the adhesive, the shear strength of the package itself will be the primary consideration. Since a fundamental aspect of this invention is that the lap seam can be separated without tearing the package material, the adhesive must be weaker than the package itself, at least by the time the popping process is complete. Preferably, this is accomplished with an adhesive that diminishes in strength when subjected to heat or steam. Thus the lap seam will remain relatively strong before the cooking process, but will weaken during the very process that marks the end of its required service.

Selection of the adhesive will also depend on the surfaces upon which it is applied. For instance, if the overlapping edges are connected directly together, the bond will likely be affected by the porosity of the panel surfaces. Alternatively, if the panels are to be coated with a grease-proof barrier or mylar, the bonding strength might be reduced. In the preferred package, both the inner and outer sheets are treated with a flourocarbon treatment for improved grease resistance.

Adhesives that works particularly well in the two-ply package described above include water based vinyl acetate, water based rubber latex, water-based acrylic complexes, and water-based blends of elastomeric emulsions. These adhesives are particularly advantageous for this application because their tensile and shear strengths decrease upon exposure to the heat and steam generated during an average popping process. However, the adhesive will remain strong enough to hold the lap seam 36 together despite the 350° plus temperatures present during atypical microwave popping process. It should be noted again, that a particular adhesive will not be ideal for every style and weight of package, but has to be chosen to work well on the selected package material.

Referring now to the embodiment illustrated in FIGS. 5–8, the package 1 described in FIGS. 1–4 can be further refined to permit the detachment of a lengthwise middle section 16. In this embodiment the first section 34 further includes a tear line 18 which is parallel to, but off-set from the lap seam 36. The first section 34 is divided by the tear line into the middle section 16 which lies between the tear line and the lap seam, and an outer section 17 which lies between the tear line and adjacent side panel 6. The tear line 18 is a narrow strip of material which has a lower structural strength than the immediately adjacent package material. Following the general rule that a tear will continue along the path of least resistance, the purpose of this tear line 18 is to allow the consumer to tear the middle section 16 off the package 1, leaving the usable open-topped vessel as illustrated in FIG. 8.

When the middle section 16 is peeled down to the adhesive that joins the bottom ends 12 of the front panel 2 and the back panel 4, one of several things can happen. The adhesive can give way such that the bottom end of the middle section 16 will detach from package 1; the middle section can be torn along side of the adhesive to remove all but the bottom end 12; or the middle section can simply remain attached to the remainder of the package and folded out of the consumer's way. Any one of these approaches will provide the consumer with access to the popped popcorn 15 through the opening thus formed.

If a tear were to stray outward from the tear line 18, it could weaken the outer section 17 and possibly the side panel 6, thereby greatly reducing the overall structural integrity of the package 1, and causing package to lose its shape and definition. Alternatively, if a tear were to stray onto the middle section 16 the opening left behind might be too small to allow the consumer good access to the interior of the package 1.

As shown in FIG. 5, the back panel 4 further includes a small incisions 20 at the top end of the tear line 18. This incision serves the dual purposes of initiating any tearing of the back panel 4 along the tear line 18 and of forming a pull tab 22 between the tear line 18 and the lap seam 36. Ideally the backside of the pull tab 22 does not have any adhesive applied to it so that it remains free of the front panel 2. Thus, the consumer can use the pull tab 22 to grip the top of middle section 16 when tearing it off. However, some adhesive should be applied on the top end of the back panel 4 beside the pull tab 22 to seal the top end 10 of the package 1. Otherwise the unpopped kernels 14 may escape during storage, or the popped kernels 15 and steam might escape prematurely during the popping process.

Experimentation has shown that after a package of popcorn has expanded to accommodate the popped volume, transverse stresses on the package tend to cause any tears initiated along the longitudinal axis of a panel tend to turn outwardly toward the outer sections of that panel as well as to the adjacent panels. Thus to remove the rectangular middle strip 16 from the package 1, a guide should be included to direct the tear along the tear lines 18 toward the bottom end 12 of the package 1. Such a guide can be constructed in various ways. The material adjacent the tear lines 18 can be reinforced relative to the material along the tear line, the material along the tear line can be weakened relative to the adjacent material, or the package can include a combination of these features.

The embodiment illustrated in FIGS. 5–8 includes an outer reinforcement strip 24 and an inner reinforcement strip 26 of pressure sensitive tape applied to the back panel 4 to reinforce the material immediately adjacent the intended tear line 18 on either side. The material forming the reinforcement strips 24 and 26, and the adhesive securing the strips, should be capable of withstanding temperatures up to 350° F. Preferred materials for the reinforcement strips include polypropylene or oriented polyethylene teraphthalate ("PET") materials. The strips can be applied to the package 1 by tape dispensers which roll the tape onto the surface of back panel 4 as the package passes through manufacturing machines. After the reinforcement strips have been applied, additional pressure can be applied to the strips, thereby assuring proper adhesion. The material of the back panel 4 itself is also preferably weakened along tear line 18 by impressing a score line 32 onto the material between the reinforcement strips 24 and 26.

It is important to note that each of the reinforcement strips 24,26 as well as the score line 32 provide an independent means for guiding the tear down the package. The score line 32 is typically the least expensive and easiest to apply, and the outer reinforcement strip 24 is typically more effective than the inner reinforcement strip 26 (since the longitudinal tear will tend to turn outwardly as discussed above). These elements may be applied to the package individually or, where more incentive to control the tear is desired, they may be applied in the redundant fashion illustrated in FIGS. 5–8.

Preferably, the tear line 18 also coincides with the inner edges of the folded gussets 7 (as best illustrated in FIG. 6). Packages tend to be naturally weakened along this area. During the manufacturing and filling process, and possibly during subsequent handling, the abrupt change in thickness of the package leads to the breakage and separation of fibers creating the panels. The greater the number of gussets, and hence the greater the difference in thickness, the more pronounced this effect will be. Multiple gussets are also preferable over single gussets because the inter-gusset dimension of a single gusset package will generally be too small to permit separation lines to be placed along the gusset edges. Moreover, multiple gussets will not extend as far into the package after it has been inflated, thereby giving the consumer better access to the popcorn.

An alternative embodiment of the present invention, illustrated in part in FIG. 10, is similar to that illustrated in FIGS. 5–8 with the exception that the no reinforcement strips are used, and the score line is replaced by a line of perforations 31. Perforations are advantageous in that they provide a significant reduction in strength, but they also create a possibility that the shortening may leak through, particularly when liquefied under heat, and care must be taken not to weaken back panel 4 so much that it might prematurely split during the popping process. In addition, contamination must be prevented from entering the package through the perforations. These problems can be addressed with a cover strip 33 which is applied over the perforations 31. A tab can be fashioned on the end of cover strip 33 to provide a handhold by which the cover strips can be removed prior to detaching the middle section 16.

The embodiment of the present invention illustrated in part in FIG. 9 is also similar to that illustrated in FIGS. 5–8 with the exception that here the score line 32 is removed and the reinforcement strips 24 and 26 are combined into a single wider strip 27. This wider strip 27 extends to both sides of the tear line, and a series of perforations 30 is formed near the centerline thereby creating the weaker section that defines the tear line. The perforations 30 are also placed in alignment with, and preferably extend slightly into, the incision 20 so that when the middle section 16 is detached, the tear will be initiated at the incisions and travel along the perforations. Again this wider reinforcement strip 27, and the adhesive used to apply it, should be able to withstand relatively high temperatures of up to approximately 350° F.

An inherent advantage associated with the embodiments of FIGS. 1–10 is that they all can be manufactured from a single sheet of panel material. This is accomplished with a single strip or roll of microwave transmissive material that is rolled to create a tube of sorts. Folds are formed in the tube to create the gussets 7 between adjacent panels, and a susceptor 9 is positioned on the interior face of the front panel 2, preferably between two plies of a two-ply bag or otherwise covered. The adjoining ends of the strip of material slightly overlap to form the lap seam 36 between the first and second sections of the back panel, and the ends of the tube (i.e. the top and bottom ends 10,12 of the package 1) are crimped and sealed.

FIGS. 11–14 illustrate yet another embodiment of the present invention similar to that of FIGS. 5–8, except that in this case the tear line is replaced by another lap seam 36. Thus the pair of lap seams 36 divide the back panel 4 into three sections: a middle section 16 between, and slightly overlapping, two outer sections 17. As best illustrated in FIG. 12, the middle section 16 preferably overlaps the outer sections 17 at both lap seams, and the lap seams are bonded with releasable adhesive 37. A pull tab 23 can be fashioned at the top end 10 of the middle section 16 by leaving a portion of the top end free of adhesive. Thus after the popping process is complete, the middle section 16 can be detached by separating the top end 10 of the middle section 16 via pull tab 23, and peeling the middle section down the package 1 until it is connected only at the bottom end 12, as illustrated in FIG. 14. From there the middle section 16 can either be pulled entirely off the package or folded out of the consumer's way.

In another embodiment of the present invention, illustrated in FIGS. 15–18, the back panel includes a frame 41 and a cover 42. Frame 41 is joined to both side panels 6, 8 and the front panel 2 at the top and bottom ends 10,12. An opening 43 near the center of the frame 41 provides access to the interior of the package when exposed. Cover 42 is adhered to the periphery of the opening along a circumferential lap seam 36, and again the lap seam is bonded with releasable adhesive 37. Thus when the popping process is complete, the cover can be peeled away from the frame to provide access to the interior of the package through the opening 43. Preferably the adhesive 37 does not extend all the way to one of the edges of the cover 42 thereby fashioning a pull tab 25 which will provide a handhold with which detachment of the cover can be initiated.

It should be noted that the embodiments of FIGS. 11–18 are especially advantageous in that both require little if any tearing of the package to create an opening. Thus they are less susceptible to the human errors that can accompany packages requiring consumers to direct a tear along a certain path. However, manufacturing these packages requires the alignment and bonding of multiple independent panels.

The popping process is essentially the same for all of the packages described in FIGS. 1–18. When the package 1 is to be used by a consumer, it is placed in a microwave oven with front panel 2 facing downward. As energy is absorbed by the charge of popcorn kernels 14, the interior moisture content of the kernels is converted into steam, the pressure of which eventually ruptures the tough outer layer, or pericarp, of the kernels. The soft inner starches then rapidly expand to form the white fluffy material commonly thought of as popcorn. Initiating and accelerating this process is the susceptor 9 which converts a portion of the microwave energy into heat to raise the temperature of the kernels. As the steam from the initial pops fills the package 1, the package is forced to expand by straightening and unfolding the gussets 7 of the side panels 6 and 8, creating a vertical space of considerable height above the front panel 2 to permit free and unrestricted popping action until the package reaches its fully expanded shape. The package of FIG. 19 works in essentially the same manner except that the bottom panel 3, rather than the front panel 2, is placed downwardly.

After the package 1 has been removed from the oven, the consumer can convert it into a serving vessel in the ways described above. With the lengthwise opening thereby created, the consumer can reach directly into the package 1 to access the exposed popcorn 15. This is advantageous compared to opening the package 1 from the top end 10 (or the bottom end 12), as the consumer will have far less contact with the interior surfaces of the package. Moreover, the consumer can conveniently add seasonings or toppings to the exposed popcorn 15 before eating. Such seasonings or toppings can include, for example, salt, butter, butter substitutes or caramel.

Although the invention has been described in detail with reference only to certain embodiments, those skilled in the art will appreciate that various modifications can be made without departing from the spirit of the invention. With such possibilities in mind, the invention is defined with reference to the following claims.

I claim:

1. A charge of popcorn kernels in combination with an expandable package for storing the popcorn and capable of being converted into a vessel for serving the popcorn:

a charge of popcorn kernels being for preparation by a popping process whereby the charge is heated by microwave energy which converts moisture contained within the kernels into steam under sufficient pressure to cause the kernels to rupture and release the steam;

a package having a top end and a bottom end and comprising a front panel, a back panel and two side panels of flexible material;

said front and back panels being joined at the top and bottom ends, and said side panels closing the sides of the package thereby forming an inner cavity in which the charge of popcorn is enclosed;

said panels each having an interior surface in communication with the inner cavity and an exterior surface opposite the interior surface;

said side panels each having multiple, parallel, inwardly directed folds extending from the top end to the bottom end of the package, said folds forming multiple gussets that can collapse and expand such that when the gussets are collapsed the package assumes a substantially flat configuration, and when the gussets are expanded the package assumes an expanded configuration;

said back panel comprising a middle section disposed between two outer sections, wherein the middle and outer sections extend longitudinally along the package, wherein outer edges of the middle section overlap adjacent edges of the outer sections along two lap seams, wherein each lap seam extends longitudinally between the top and bottom ends of the package, wherein the interior surface of the middle section contacts the exterior surface of the outer section along each lap seam, and wherein each lap seam is located directly adjacent the gussets of the adjacent side panel when the package is in the substantially flat configuration; and, said lap seams each being bonded to the exterior surface of the outer sections by a releasable adhesive having a bonding strength sufficient to maintain the lap seams bonded to the exterior surface during the popping process, and yet weak so that after the popping process has been completed the middle section can be peeled away from the outer sections by separating the lap seams thereby providing access to the interior of the package between the outer sections.

2. The combination of claim 1 wherein heat and steam generated during the popping process will cause the bonding strength of the adhesive to diminish.

3. The combination of claim 1 further comprising a pull tab joined to the top end of the middle section, wherein the pull tab is free of adhesive to provide a handle with which detachment of the middle section can be initiated.

4. The combination of claim 1 further comprising a susceptor mounted on the front panel.

* * * * *

UNITED STATES PATENT AND TRADEMARK OFFICE

CERTIFICATE OF CORRECTION

PATENT NO. : 6,077,551
DATED : June 20, 2000
INVENTOR(S) : Cynthia Scrimager

It is certified that error appears in the above-identified patent and that said Letters Patent is hereby corrected as shown below:

Column 11,
Line 49, after "kernels being" insert -- suitable --.

Signed and Sealed this

Seventh Day of May, 2002

*Attest:*

*Attesting Officer*

JAMES E. ROGAN
*Director of the United States Patent and Trademark Office*